US008782976B2

(12) United States Patent
Meyer

(10) Patent No.: US 8,782,976 B2
(45) Date of Patent: Jul. 22, 2014

(54) BI-SURFACED RAISED ACCESS FLOOR PANEL AND COLD ISLE FORMING SYSTEM IN A DATA CENTER

(71) Applicant: Gary Meyer, Golden, CO (US)

(72) Inventor: Gary Meyer, Golden, CO (US)

( * ) Notice: Subject to any disclaimer, the term of this patent is extended or adjusted under 35 U.S.C. 154(b) by 0 days.

(21) Appl. No.: 13/668,568

(22) Filed: Nov. 5, 2012

(65) Prior Publication Data

US 2014/0123576 A1 May 8, 2014

(51) Int. Cl.
*E04C 2/52* (2006.01)

(52) U.S. Cl.
USPC ..... 52/220.8; 52/263; 52/126.6; 52/302.3; 52/126.7; 52/126.4; 454/247; 454/289

(58) Field of Classification Search
USPC ..... 52/511, 506.05, 506.02, 263, 126.6, 52/220.1, 220.2, 220.8, 302.3, 302.1, 52/126.1, 126.2, 126.3, 126.4, 126.7; 248/161; 454/247, 289
See application file for complete search history.

(56) References Cited

U.S. PATENT DOCUMENTS

| | | | | | |
|---|---|---|---|---|---|
| 3,391,629 | A * | 7/1968 | Snell | 454/290 |
| 3,924,370 | A * | 12/1975 | Cauceglia et al. | 52/126.6 |
| 4,922,670 | A * | 5/1990 | Naka et al. | 52/126.6 |
| 5,057,355 | A * | 10/1991 | Klingelhofer et al. | 428/192 |
| 5,386,670 | A * | 2/1995 | Takeda et al. | 52/126.6 |
| 5,459,968 | A * | 10/1995 | Jin | 52/126.6 |
| 5,467,609 | A * | 11/1995 | Feeney | 62/259.2 |
| 6,019,677 | A * | 2/2000 | Demster | 454/290 |
| 6,101,768 | A * | 8/2000 | Springstead et al. | 52/126.6 |
| 7,031,154 | B2 * | 4/2006 | Bash et al. | 361/690 |
| 7,360,343 | B1 * | 4/2008 | Spransy et al. | 52/263 |
| 7,644,550 | B2 * | 1/2010 | Meyer | 52/263 |
| 7,779,587 | B1 * | 8/2010 | Meyer | 52/263 |
| 7,975,443 | B2 * | 7/2011 | Meyer et al. | 52/223.6 |
| 8,056,300 | B2 * | 11/2011 | Meyer | 52/745.06 |
| 8,091,302 | B2 * | 1/2012 | Meyer | 52/263 |
| 2008/0279685 | A1 * | 11/2008 | Kessler et al. | 416/31 |

* cited by examiner

*Primary Examiner* — Chi Q Nguyen
(74) *Attorney, Agent, or Firm* — Scott L. Terrell; Scott L. Terrell, P.C.

(57) ABSTRACT

A bi-surfaced raised access floor panel is provided. The panel is constructed with a cross-braced framework. A generally square plate is rigidly connected to an upper surface of the framework. The plate has four corner formations and is bisected symmetrically to define first and second halves. The first halve is substantially configured as a solid load bearing surface which is adapted to support a data processing server. The second halve includes a plurality of clear perforations capable of circulating an air flow as an element of a cold aisle forming installation in a data center.

3 Claims, 3 Drawing Sheets

BI-SURFACED RAISED ACCESS FLOOR PANEL AND COLD ISLE FORMING SYSTEM IN A DATA CENTER

Pursuant to 35 U.S.C. 119(e), Applicant claims the benefit of U.S. Ser. No. 61/555,928, filed on Nov. 4, 2011, pursuant to 35 U.S.C. 111(b).

STATEMENT OF FEDERALLY SPONSORED RESEARCH

Not Applicable.

BACKGROUND OF THE INVENTION

1. Field of the Invention

The present invention relates to hot aisle/cold aisle containment systems. In particular, it relates to improvements in floor panel design for narrowing the width of cold isles in data centers.

2. Description of the Related Art

Raised floors are used in data centers to create a space between a sub-floor of the building and the normal working environment of the computer room. The space between the sub-floor and the raised floor panels creates an under-floor cool-air circulating plenum for thermal management of the data processing servers installed in banks of rack systems on top of the raised floor. The floor panels, themselves, are either solid or perforated. The solid panels are typically used for supporting a heavy or rolling load. Of the perforated panels, manufacturers have made new design changes in an effort to increase the available open area of the panels, in order to increase the air flow of cooling air throughout the room. These efforts have led to the production and use of air-grate raised floor panels.

A further refinement, in the use of air-grate floor panels, came in the early 2000s, when scientists advanced the concept of "hot aisle/cold aisle", as an additional means for attempting to achieve air separation within the server room. This design includes three basic components to achieve hot aisle/cold aisle separation. Those components involve the use of air conditioners, fans and perforated raised floor panels, in combination, to act synergistically in the construction of a cooling infrastructure, as a means to separate and contain the inlet cold air and the exhaust hot air. With this approach, the cabinets are supported on a raised floor and are connected into a series of rows. The fronts of the racks face each other and become the cold aisles, as a result of the inherent front-to-back heat dissipation of most IT equipment. The air conditioning units are positioned around the perimeter of the room, or at the end of hot-aisles, so that they push cold air under the raised floor and through the cold aisle. The perforated raised floor panels are placed only in the cold aisles which concentrates cool air to the front of racks in order to get sufficient air flow into the server intake. In this manner, all of the servers should be mounted so that their server door air intake is facing the front of the rack, and their exhaust door is facing the rear. As the air moves through the servers, it is heated and eventually dissipated into the hot aisle. The exhaust air is then routed back to the air handlers.

This design, which aligns data center cabinets into alternating rows, endures in critical facilities throughout the world, and is widely regarded as the first major step in improving airflow management. In use, part of this air flow, or stream, enters the racks and then the equipment, and part of the air flow bypasses the equipment and returns to the air handling units. The air that enters the server doors is heated, and then exhausted through the back of the servers where it is recycled as return air into the air handling units. Typically, some intermixing of the hot and cold air paths is experienced due to improper sealing in the rack, or recirculation above and around the sides of the rack rows. The air-grate panels include perforated top plates, connected to the air-grate structural frame members, in order to provide a variety of different working surfaces having a desired aesthetic appearance, or with the perforations, or openings, in the plate configured so as comply with certain federal and state regulations, as they relate to occupational safety and/or persons with disabilities, or to increase air flow and cooling efficiency.

The Accessibility Guidelines of the Americans with Disabilities Act ("ADA") sets forth minimum standard requirements for accessibility in public places. In application, these requirements effectively regulate an approximately 91 centimeters, or 3 foot, minimum width requirement which is available for use in the construction of cold aisles between rows of server racks. However, this mandate is inconsistent with the 61 cm×61 cm on center square geometry of those raised floor pedestal support systems which have gained universal acceptance in the industry. There, the cold aisle is created by installing two adjacent rows of 61 cm×61 cm on center air-grate panels and supporting the server racks with rows of rows of 61 cm×61 cm solid surfaced panels. It follows that the universally accepted cold aisle construction is thereby approximately 122 cm, or 4 feet wide, which is approximately 30.5 cm, or one foot, greater than the minimum mandated under the ADA. Thus, because of the square geometry of the universally accepted raised floor systems in accordance with the prior art, in order to comply with the ADA regulations, one must either purchase more total surface area to construct a facility having a predetermined data processing capacity, or must effectively reduce the concentration of server units within an existing surface area for use in data processing.

One such solution has heretofore been to provide rectangular air-grate floor panels, configured with a dimension of approximately 61 cm×91 cm, for cold-aisle specific installation. While this installation will effectively narrow the cold aisle and eliminate the 30.5 cm of unused space, it is somewhat impractical, because it inherently requires one to make corresponding changes to the 61 cm×61 cm on center configuration of new or existing the pedestal support systems at the cold aisle, so that it is capable of supporting the cold aisle specific rectangular panels. Altering the square geometry of the pedestal support members, so that they are capable of supporting the cold aisle specific rectangular air-grate floor panels complicates any subsequent rearrangement or replacement of the floor panels, the rows or server racks, or with new or existing panels of differing manufacture.

Thus, what is needed is an interchangeable raised floor access panel which is compatible for use with the existing 61 cm×61 cm on center pedestal support systems, but which is also capable of installation in the formation of a cold aisle which is narrowed to the mandatory minimum, 91 cm, width. The present invention satisfies these needs.

BRIEF SUMMARY OF THE INVENTION

It is therefore an object of the present invention to provide an interchangeable raised floor access panel which is compatible for use with the existing 61 cm×61 cm on center pedestal support systems, but which is also capable of installation in the formation of a cold aisle which is narrowed to the mandatory minimum, 91 cm, width.

It is yet another object of the present invention to provide a hot aisle/cold aisle containment system formed on a substantially 61 cm×61 cm on center pedestal support system with a substantially 91 cm, or 3 foot, cold aisle width.

It is yet another object of the present invention to provide a method for making a hot aisle/cold aisle containment system on a substantially 61 cm×61 cm pedestal support system with a substantially 91 cm cold aisle width.

To overcome the problems of the prior art, and in accordance with the purpose of the present invention, as embodied and broadly described herein, briefly, a bi-surfaced raised access floor panel is provided. The bi-surfaced panel has a cross-braced framework. A generally 61 cm×61 cm square plate is rigidly connected to an upper surface of the framework. The plate has four corner formations and is bisected symmetrically to define first and second halves. The first halve includes a substantially a solid load bearing surface. The solid surface is adapted to support a data processing server. The second halve includes a plurality of clear perforations adapted to circulate an air flow.

Additional advantages of the present invention will be set forth in part in the description that follows, and, in part, will be obvious from that description or can be learned from practice or testing of the present invention. The advantages of the preferred embodiments of the present invention can now be realized and obtained by the invention as more particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the present invention and, taken together with the description, explain the principles of the invention.

DETAILED DESCRIPTION OF THE DRAWINGS

Figure 1:
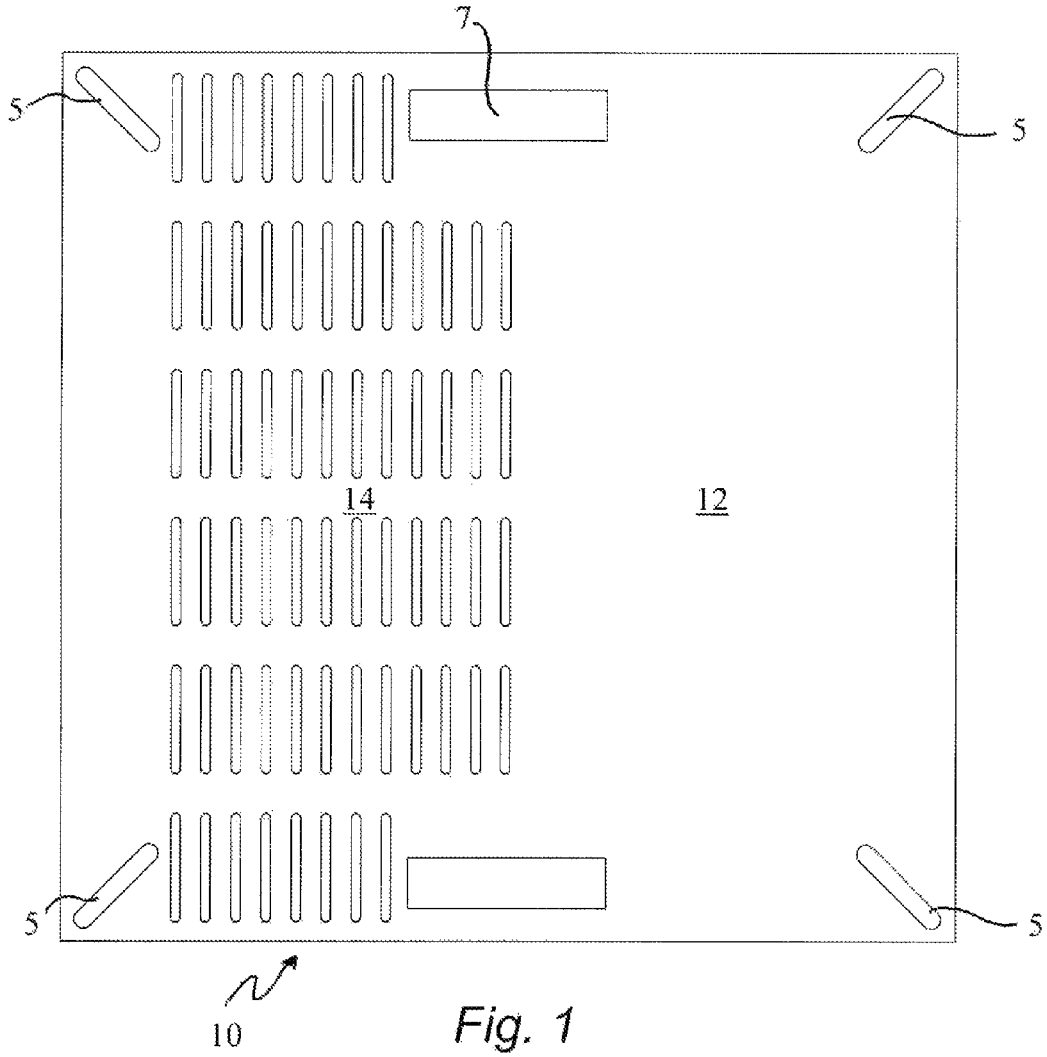
FIG. 1 is a top view of the bi-surfaced raised floor access panel in accordance with the present invention. The figure illustrates the solid and air-grate surfaces, diagonal clear slots for operating the panel levelers, and rectangular integrated panel lifters. The panel lifters 7 are disclosed in U.S. Pat. No. 7,779,587, to Meyer, issued on 24 Aug. 2010, and entitled: Raised Floor Access Panel. The disclosure of U.S. Pat. No. 7,779,587 is incorporated by reference, as though fully set forth herein.
Figure 2:
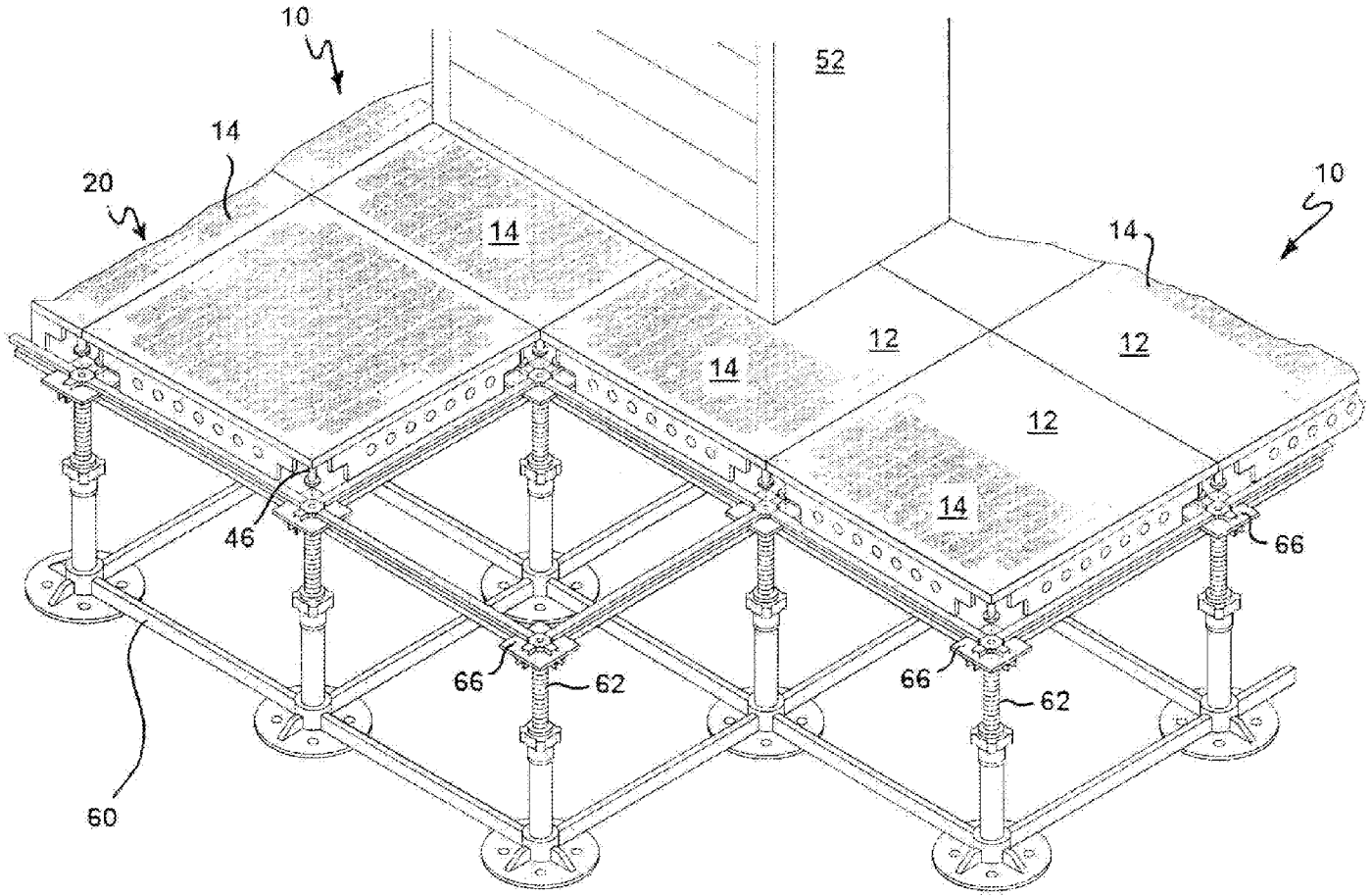
FIG. 2 is a perspective view from the upper plenum of a data center showing a row of the bi-surfaced raised access floor panels installed, adjacent to a row or air-grate floor panels, on the 61 cm×61 cm pedestal support system, in order to form the 91 cm wide cold aisle on the 61 cm×61 cm on centers pedestal support system. As shown in the drawing figure, the server cabinets are positioned on the solid, or first halve, surface of the bi-surfaced floor panels so that an air-flow rises through the cold aisle and into the front of the server cabinets for cooling the servers. Heated air is exhausted out of the back portion of the server cabinets, is cooled by the computer-room air-conditioning units, and the cooled air is supplied to the under floor plenum for recirculation through the cold aisle formed in accordance with the present invention.
Figure 3:
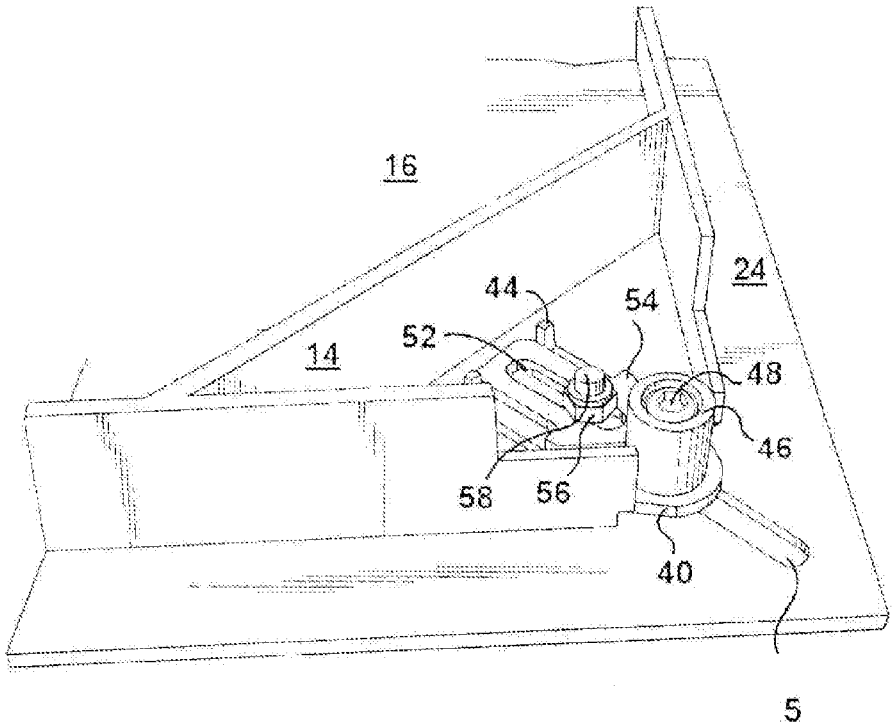
FIG. 3 is a perspective view, from the lower left hand corner, of the presently preferred embodiment of the articulating corner bracket and top set leveler assembly.
Figure 4:
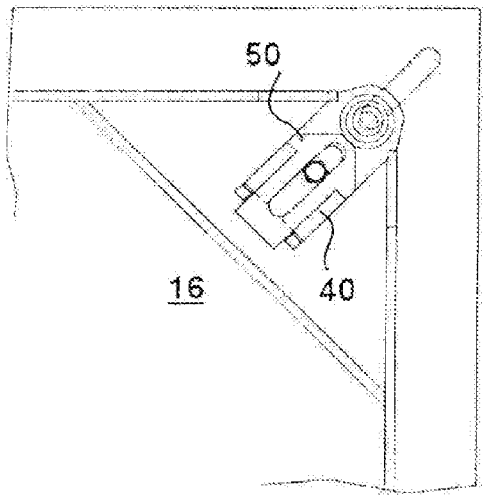
FIG. 4 is a bottom view of the panel top set leveling assembly showing the bracket adjusted in an inboard position which effectively reduces the foot-print of the floor panel.
Figure 5:
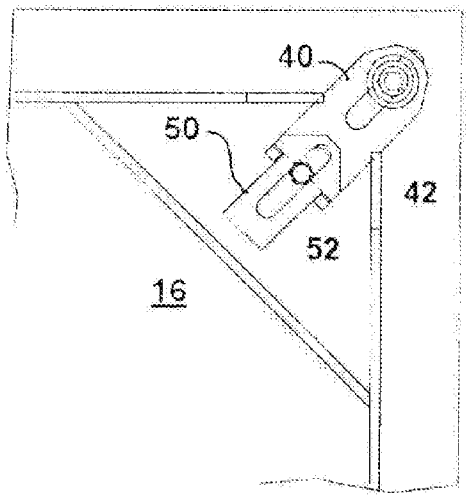
FIG. 5 is a bottom view of the panel top set leveling assembly showing the bracket adjusted in an outboard position which effectively expands the foot-print of the floor panel.

Unless specifically defined otherwise, all scientific and technical terms, used herein, have the same ordinary meaning as would be commonly understood by one of ordinary skill in the art to which this invention belongs. In practice, the present invention improves "cold aisle containment" by generally ensuring that the cold air stays at the server intake, while the computer room air conditioners, or air handlers, receive the warmer exhaust air, thus improving their efficiency. Moreover, the invention enhances the "capture of exhaust air" via in-row air conditioners which condition it, and return it via the lower plenum and directional air-grate cold aisle formed with the present invention. Air conditioning efficiency is further improved as neither the hot exhaust air nor cold inlet air has far to travel. The term "lower plenum" means that portion of the computer room created below the air-grate floor panels when installed on a pedestal support system. The term "upper plenum" means that portion of the computer room created above the air-grate floor panels, including the data processing server equipment and in-row air conditioners, or air handling units. Thus, the term "computer room" means the overall air handling environment including the upper and lower plenums from the subfloor to ceiling. Finally, "CRAC units" means those computer room air conditioning units typically located at the perimeter of the data center floor surrounding the (server) racks, or in-rows, to circulate air in the data center space to create a cooling loop. Finally, the phrase "on center" means a supporting structural member substantially located from the centre of one structural member to the centre of another. For instance, floor panels and pedestal supporting members, described herein, are described and configured for installation on a pedestal support system which is substantially 61 centimeters, or 2 feet, on centers, each way.

Although any methods and materials similar or equivalent to those described herein, can be used in the practice or testing of the present invention, the preferred methods and materials are now described. Reference will now be made in detail, to the presently preferred embodiments of the invention, including the examples of which are illustrated in the accompanying drawings. In the drawings, like numerals will be used in order to represent like features of the present invention.

The present invention provides a bi-surfaced raised access floor panel 10. The panel 10 is constructed with a cross-braced framework made of thin rectangular plate members. The cross-braced framework has four side rail members, and at least one cross-brace member. The cross-brace members are connected to the rail members so that the cross-brace member spans an area defined by the rail members. A generally 61 cm×61 cm square plate is rigidly connected to an upper surface, such as by welding, of the framework. The plate has four corner formations and is bisected symmetrically to define a first 12 and a second halve 14 of the plate. The first halve 12 is substantially a solid load bearing surface which is adapted to support a data processing server 52. The second halve 14 includes a plurality of clear perforations capable of circulating an air flow through the second halve 14 surface of the panel plate.

In another embodiment, the raised floor panel plate defines an upper working surface and a lower plenum surface 16. Each of the corner portions includes a diagonal clear slot 5 positioned along a diagonal vector relative to the frame rails of the cross-braced frame. The plate further includes an articulating bracket 40. The bracket 40 includes a horizontal sheet including proximal and distal portions. The proximal portion includes a central clear slot 52 adapted to receive a threaded fastener 58. The distal portion includes a vertically extending collar 46 having an internally threaded clear hole adapted to receive a leveling screw 48. The leveling screw 48 includes a tool operating end and a foot end. The foot end is adapted to bias against a pedestal head 66 of a standard 61 cm×61 cm on center pedestal support system 60. The proximal portion of the sheet is slidably connected the lower surface 16 of the corner portion with the threaded fastener 58 extending through the central clear slot 52 so that the articulating bracket 40 is capable of sliding a distance which varies linearly along the diagonal vector to adjust a footprint of the floor panel 10 for interchangeable fitment with an existing raised floor support system 60. The tool operating end of the leveling screw 48 is operable through the diagonal clear slot 5 in the corner portion so that the upper surface is capable of vertical adjustment and planar alignment with an existing floor panel.

In yet another embodiment a hot aisle/cold aisle containment system for cooling computer servers on a raised floor in a data center is provided. The containment system includes a substantially 61 cm×61 cm on center pedestal support system 60 including a plurality of vertically extending pedestal supports 62 each having an upper end connected to a pedestal support head 66 and a lower end connected to a pedestal support base. The pedestal supports 62 are each connected in a matrix orientation with a plurality of horizontal stringers. A first row of bi-surfaced raised access floor panels 10 is provided. The first row of the bi-surfaced panels 10 each include the cross-braced framework, and a, generally 61 cm×61 cm square, plate connected to an upper surface of the framework, in the same manner as described above. The plate has four corner formations and is bisected to define a first 12 and second halve 14. The first halve 12 is a substantially solid load bearing surface which is adapted to support a data processing server 52. The second halve 14 includes a plurality of clear perforations adapted for air flow circulation. A second row of air-grate raised access floor panels 20, have the substantially 61 cm×61 cm square perforated plate connected to the upper surface of the framework. These plates also have four corner formations. A substantially 91 cm wide cold aisle is adapted for installation on the 61 cm×61 cm pedestal support system 60. The cold isle is defined by the installation of the second halves 14 of the first row of the bi-surfaced raised access floor panels 10 adjacent to a second row of air-grate floor panels 20. In this manner, the first and second rows of floor panels are supported on the 61 cm×61 cm on center pedestal support system 60, so that the perforations, in combination, are capable of creating a cold aisle which is substantially 91 cm wide for circulating an airflow from a lower plenum chamber through the cold isle and into a front of at least one server cabinet 52 positioned, in part, on the solid surface portion 12 of the bi-surfaced raised access floor panels 10.

In a second embodiment of the containment system, the floor panels include the panel levelers, described above, so that the floor panel portions of the containment system are interchangeable with the panels and pedestal support system of varying manufacturer.

In yet another embodiment of the present invention, a method for making a cold aisle for cooling computer servers on a raised floor in a data center is provided. Here the method includes the steps of providing a 61 cm×61 cm on center pedestal support system 60 including a plurality of vertically extending pedestal supports 62. Each of the supports 62 have an upper end connected to a pedestal support head 66 and a lower end connected to a pedestal support base. The pedestal supports 62 are each connected in a substantially 61 cm×61 cm on center configuration with a plurality of horizontal stringers. A first row of bi-surfaced raised access floor panels 10 is provided. The bi-surfaced panels 10 each include a cross-braced framework and a generally 61 cm×61 cm, square, plate connected to an upper surface of the framework. The plate has four corner formations and is bisected to into a first and second halve. The first halve 12 is substantially a solid load bearing surface adapted to support a data processing server 52. The second halve 14 includes a plurality of clear perforations adapted to circulate and air flow. A second row of air-grate raised access floor panels 20 having a generally 61 cm×61 cm square perforated panel plate is installed adjacent to the first row of bi-surfaced panels 10. The air-grate panel plate has four corner formations and the perforations are adapted to circulate and air flow. The first and second rows are installed on the pedestal support system 60 so that the second halve 14 of the bi-surfaced panels runs adjacent to the second row of air-grate panels 20. In this manner, in combination, the first and second rows of panels 10, 20 are adapted to define a substantially 91 cm wide cold aisle which is capable of circulating an airflow from a lower plenum chamber through the cold aisle, formed thereby, and into a front of at least one server cabinet 52 door positioned on the solid load bearing surface of the first halve 12 of the first row of bi-surfaced raised access floor panels 10.

Finally, in yet another presently preferred embodiment of the method of the present invention, the floor panels 10, 20 include the panel leveler assemblies, described above, so that the floor panel portions of the cold aisle are interchangeable with the panels and pedestal support system of varying manufacturer. Thus, with this embodiment, the method further includes the step of adjusting the panel leveler assemblies 40 of at least one of the floor panels 10, 20, from the upper surface of a raised floor, so that the upper surface is co-planar in alignment with an adjacent floor panel or stringer.

While the present invention has been described in connection with the illustrated embodiments, it will be appreciated and understood that modifications may be made without departing, from the true spirit and scope of the invention.

I claim:

1. A containment system for cooling computer servers on a raised floor in a data center, comprising:

(a) a pedestal support system including a plurality of vertically extending pedestal supports each having an upper end connected to a pedestal support head and a lower end connected to a pedestal support base, said pedestal supports each connected in relation to the other in an on centers each way square matrix orientation with a plurality of horizontal stringers;

(b) a first row of bi-surfaced raised access floor panels, said bi-surfaced panels each comprising a floor panel sub-frame and a generally square plate member, said plate member having an upper working surface and a lower plenum surface, said lower plenum surface forming a built-up member connection with an upper surface of said sub-frame, said plate having four corner formations and bisected to define a first and a second halves, wherein said first halve is substantially solid load bearing surface, and said second halve is an air grate;

(c) a second row of air-grate raised access floor panels having a sub-frame and a generally square perforated air grate plate member, said plate member having an upper working surface and a lower plenum surface, said lower plenum surface forming a built-up member connection with an upper surface of said sub-framework, said plate having four corner formations; and (d) wherein a substantially rectangular cold aisle is formed between rows of the computer servers by locating said first and second rows of floor panels in an orientation so that said second halve of said first row of said bi-surfaced floor panels are aligned adjacent to said second row of said air-grate floor panels, wherein said first and second rows of floor panels are supported on the pedestal support system, so that said perforations, in combination, are capable of circulating an airflow from a lower plenum chamber through a cold aisle formed thereby, and into a front of at least one server cabinet, and whereby at least a portion of said server cabinet is supported on said solid load bearing surface of said first halve of said first row of said bi-surfaced raised access floor panels.

2. The containment system according to claim 1, wherein each of said corner portions further includes a diagonal clear slot, said clear slot positioned along a diagonal vector relative to the frame rails, and each of the said plates further comprising an articulating bracket, said bracket including a horizontal sheet including proximal and distal portions, said proximal portion including a central clear slot adapted to receive a threaded fastener and said distal portion including a vertically extending collar having an internally threaded clear hole adapted to receive a leveling screw, wherein said leveling screw includes a tool operating end and a foot end, said foot end adapted to bias against a pedestal head of an existing pedestal support system, and whereby said proximal portion of said sheet is slidably connected the lower surface of the corner portion with the threaded fastener extending through the central clear slot so that the articulating bracket is capable of sliding a distance which varies linearly along the diagonal vector to adjust a footprint of the floor panel for interchangeable fitment with an existing raised floor support system, and wherein the tool operating end of the leveling screw is operable through the diagonal clear slot in the peripheral portion so that the upper surface is capable of vertical adjustment and planar alignment with an existing floor panel.

3. The containment system according to claim 1, wherein in said pedestal support system is configured on a substantially 61 cm×61 cm on centers orientation, and said upper surface of said plate members are substantially 61 cm×61 cm.

* * * * *